US009751223B2

(12) United States Patent
Raymond

(10) Patent No.: US 9,751,223 B2
(45) **Date of Patent: *Sep. 5, 2017**

(54) MULTI-TOOL ASSEMBLY

(71) Applicant: Dan-O-Tools, LLC, Saginaw, MI (US)

(72) Inventor: Daniel J. Raymond, Saginaw, MI (US)

(73) Assignee: Dan-O-Tool, LLC, Saginaw, MI (US)

( * ) Notice: Subject to any disclaimer, the term of this patent is extended or adjusted under 35 U.S.C. 154(b) by 317 days.

This patent is subject to a terminal disclaimer.

(21) Appl. No.: 14/497,108

(22) Filed: Sep. 25, 2014

(65) Prior Publication Data

US 2015/0082642 A1 Mar. 26, 2015

Related U.S. Application Data

(60) Provisional application No. 61/882,187, filed on Sep. 25, 2013, provisional application No. 61/946,095, filed on Feb. 28, 2014.

(51) Int. Cl.
*B26B 11/00* (2006.01)
*B43L 9/04* (2006.01)

(52) U.S. Cl.
CPC ..... *B26B 11/00* (2013.01); *B43L 9/04* (2013.01)

(58) Field of Classification Search
CPC ..... B26B 11/00; B43L 9/04
USPC ..... 7/160–164
See application file for complete search history.

(56) References Cited

U.S. PATENT DOCUMENTS 491,715 A * 2/1893 Mondor ..... B26B 11/00 30/151
2,582,488 A * 1/1952 Kroenlein ..... B43L 9/045 29/90.01
5,289,637 A * 3/1994 Coffey ..... B26B 29/06 30/233
5,430,952 A * 7/1995 Betts ..... G01B 3/1084 33/760
6,279,186 B1 * 8/2001 Ge ..... B26B 11/00 7/118
6,298,562 B1 * 10/2001 Duquette ..... B26B 11/00 30/162
6,415,514 B1 7/2002 Chun
(Continued)

FOREIGN PATENT DOCUMENTS

DE 29714180 U1 10/1997
DE 202010004932 U1 7/2010
(Continued)

OTHER PUBLICATIONS

International Search Report, mailed Jan. 16, 2015 (PCT/US2014/057531).

*Primary Examiner* — Hadi Shakeri
(74) *Attorney, Agent, or Firm* — Dickinson Wright PLLC

(57) ABSTRACT

An improved multi-tool assembly which includes a housing that extends between opposing first and second longitudinal ends is provided. The multi-tool assembly further includes a blade which is partially disposed within the housing and which projects out of the first longitudinal end of the housing. The housing has a slot which opens to the second longitudinal end of the housing and at least one tool engaging element disposed at least partially within the slot of releasably securing a tool in the slot at the second longitudinal end of the housing such that the tool projects out of the second longitudinal end of the housing.

8 Claims, 3 Drawing Sheets

(56) References Cited

U.S. PATENT DOCUMENTS

| | | | | |
|---|---|---|---|---|
| 6,513,261 | B2 * | 2/2003 | Johnson | G01B 3/1005 33/42 |
| 2004/0250423 | A1 | 12/2004 | Yu | |
| 2005/0034244 | A1 | 2/2005 | McCreesh | |

FOREIGN PATENT DOCUMENTS

| | | | |
|---|---|---|---|
| FR | 2220988 | A5 | 10/1974 |
| GB | 2252934 | A | 8/1992 |

* cited by examiner

FIG. 3
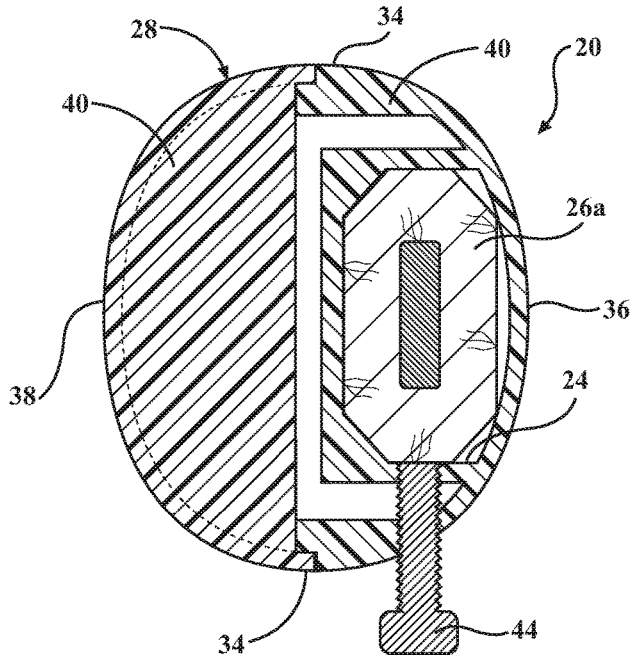
FIG. 4
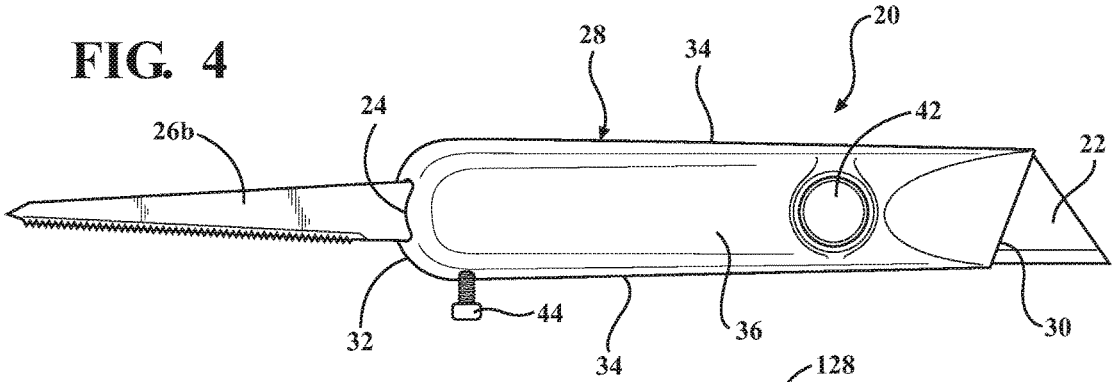
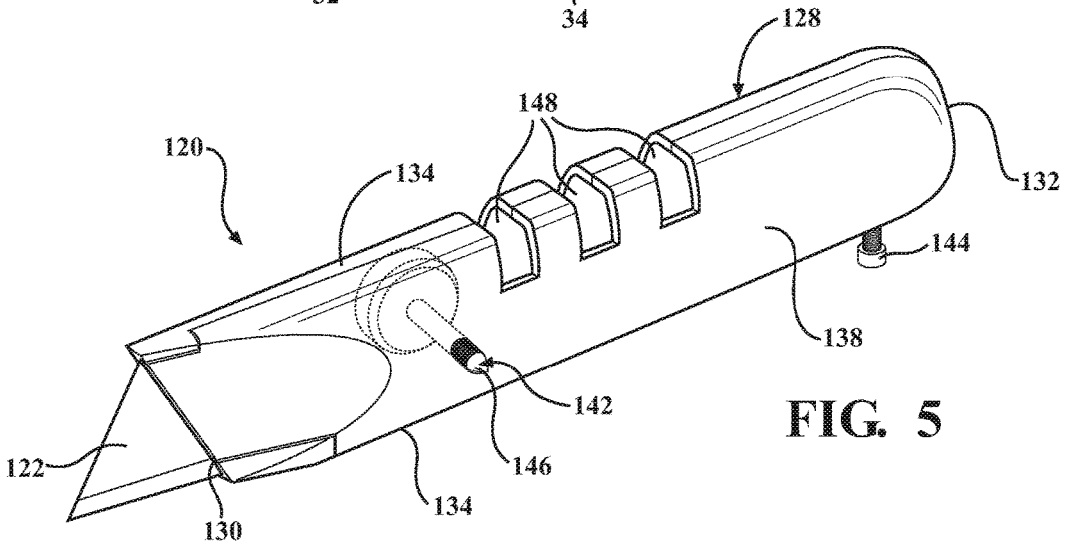
FIG. 5

MULTI-TOOL ASSEMBLY

CROSS-REFERENCE TO RELATED APPLICATION

This application claims priority to U.S. Provisional Application No. 61/882,187, filed Sep. 25, 2013 and to U.S. Provisional Application No. 61/946,095, filed Feb. 28, 2014.

BACKGROUND OF THE INVENTION

1. Field of the Invention

The present invention is related to hand-held multi-tool assemblies.

2. Related Art

People who work with drywall often make patterns on drywall panels and then cut through the drywall along the drawn patterns. As such, most drywall workers carry both a pencil (or a pen or any other writing utensil) and a utility knife and regularly switch between these two tools. Such drywall workers may also carry additional tools including, for example, a Phillips or flat head screw driver and a drywall/jab saw. In addition to the time required to switch between these two or more objects, the repeated processes of taking out and putting away the utility knife with its sharp blade could potentially be dangerous.

SUMMARY OF THE INVENTION

An aspect of the present invention provides for an improved multi-tool assembly which includes a housing that extends between opposing first and second longitudinal ends. The multi-tool assembly further includes a blade which is partially disposed within the housing and which projects out of the first longitudinal end of the housing. The housing has a slot which opens to the second longitudinal end of the housing and at least one tool engaging element disposed at least partially within the slot of releasably securing a tool in the slot at the second longitudinal end of the housing such that the tool projects out of the second longitudinal end of the housing.

The improved multi-tool assembly provides for significant efficiency and safety advantages. For example, a worker can switch between using the blade at the first longitudinal end to the tool on the second longitudinal end without having to put down or otherwise store any tools. This is particularly advantageous in the drywall industry where typical worker routinely switching between using writing utensils, such as carpenter's pencils, and utility knives. The process for switching between those two tools can be distracting and potentially dangerous if the worker accidentally makes contact with the blade. In contrast, with the improved multi-tool assembly, the worker can quickly and safely rotate the housing to switch between use of the carpenter's pencil and the blade.

Another aspect of the present invention provides for a multi-tool assembly including a housing which extends between first and second longitudinal ends and has a pair of sides and a back. The housing is made of two cover pieces which are joined together to present an open interior space between the cover pieces. A blade is partially disposed within the housing and projects out of the first longitudinal end through an opening formed between the cover pieces. At least one of the cover pieces of the housing presents a slot which opens to the second longitudinal end of the housing. A set screw extends through one of the sides of the housing and into the slot for releasably engaging a tool in the slot.

The two cover pieces of the housing are joined together with a screw which extends past the housing to a point. The housing further includes at least one recess which is spaced longitudinally from the screw and is shaped to receive a writing utensil and to hold the writing utensil in a direction that is generally parallel to the screw for drawing circular shapes by spinning the housing around the point of the screw.

BRIEF DESCRIPTION OF THE DRAWINGS

These and other features and advantages of the present invention will be readily appreciated, as the same becomes better understood by reference to the following detailed description when considered in connection with the accompanying drawings wherein:

FIG. 3 is a cross-sectional view of the first exemplary embodiment of the multi-tool assembly taken along line 3-3 of FIG. 2;

FIG. 4 is a perspective view of the first exemplary embodiment of the multi-tool assembly and with a saw received therein;

FIG. 5 is a perspective view of a second exemplary embodiment of the multi-tool assembly;

DESCRIPTION OF THE ENABLING EMBODIMENT

Figure 1:
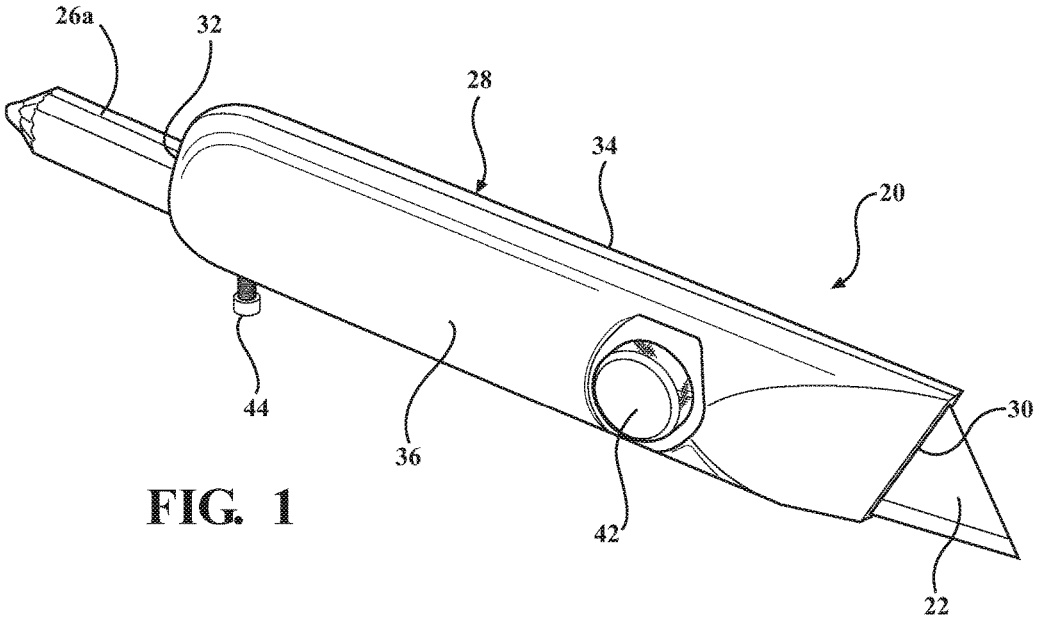
FIG. 1 perspective view of a first exemplary embodiment of a multi-tool assembly with a carpenter's pencil received therein.

Referring to the Figures, wherein like numerals indicate corresponding parts throughout the several views, a first exemplary embodiment of an improved hand-held multi-tool assembly 20 is generally shown in FIG. 1. The multi-tool assembly 20 includes a knife or blade 22 at one longitudinal end for cutting objects (such as drywall) and a slot 24 for receiving a secondary tool 26, such as a carpenter's pencil 26*a* (shown in FIG. 1) or a saw 26*b* (shown in FIG. 4), on the other longitudinal end. The multi-tool assembly 20 provides for substantial efficiency advantages since it allows a worker to conveniently perform different operations without taking his or her eyes off of the object being worked on to put down his or her utility knife and pick up a different tool. Moreover, the blade 22 and the secondary tool 26 are specifically positioned on the multi-tool assembly 20 such that it is very easy for a user to switch between which tool is being used, i.e., a worker can very easily switch between using the secondary tool 26 and the blade 22.

Figure 2:
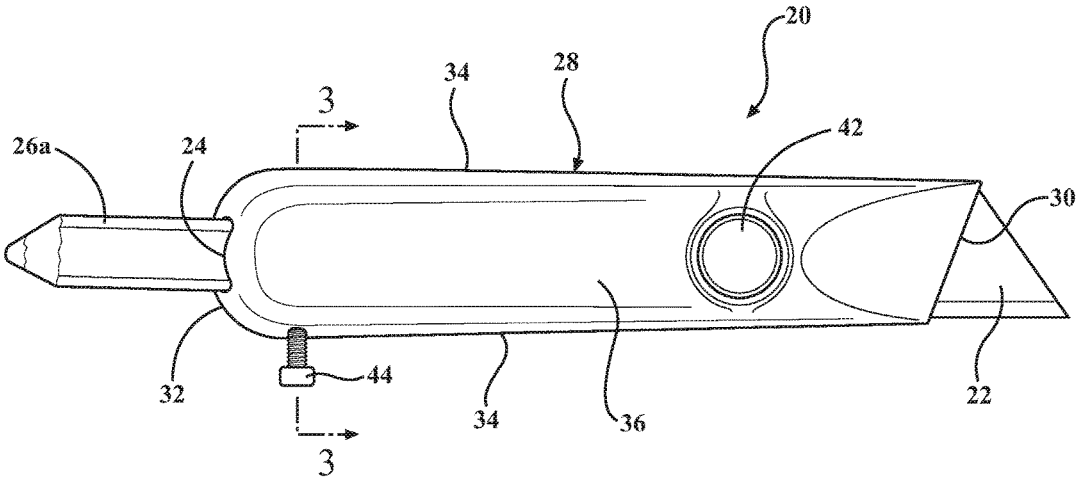
FIG. 2 is a front elevation view of the first exemplary embodiment of the multi-tool assembly.

Referring now to FIGS. 2 and 3, the first exemplary embodiment of the multi-tool assembly 20 includes a housing 28 which is generally rectangular in shape and extends in a longitudinal direction between opposite first and second longitudinal ends 30, 32. The housing 28 also has a pair of lateral sides 34, a front 36 and a back 38. As shown, the housing 28 includes two cover pieces 40 which are formed separately and are joined together via a screw 42 which extends between the cover pieces 40. When the cover pieces 40 are attached together, the housing 28 presents an open interior between the cover pieces 40. The cover pieces 40 may be made of any suitable material including, for example, plastic, nylon, metal, etc. The cover pieces 40 may be formed through any suitable process including, for example, injection molding.

The blade 22 is at least partially disposed within the open interior of the housing 28 and extends through the first longitudinal end 30 to allow the multi-tool assembly 20 to be used as a utility knife. Replacement blades 22 may conveniently be stored in the open interior of the housing 28 for use after the blade 22 dulls.

On the opposite longitudinal end from the blade 22, the housing 28 has a slot 24 which is open to the second longitudinal end 32 for receiving a secondary tool 26. As shown in FIG. 3, in the first exemplary embodiment, the slot 24 is integrally formed entirely within one of the cover pieces 40 of the housing 28. As also shown in FIG. 3, the exemplary slot 24 has an eight sided shape when viewed in cross-section with two of the opposite sides being longer than the other six sides such that the slot 24 is configured for receiving a standard carpenter's pencil 26*a*, as shown in FIG. 1. With a carpenter's pencil 26*a* received within the slot 24, this allows for new and expected results, particularly in the field of drywall work. Specifically, such a drywall worker can use the carpenter's pencil 26*a* on the one longitudinal end of the multi-tool assembly 20 to draw a pattern and can then flip the multi-tool assembly 20 around to make a cut along that pattern with the blade 22. This is far more efficient than using a pencil, putting down the pencil, finding a utility knife, picking up the utility knife and then cutting the pattern which was drawn with the pencil. Additionally, other types of secondary tools 26 can be placed in the slot 24 including, for example, a saw 26 (as shown in FIG. 4) or a Phillips head or flat head screwdriver. Preferably, each of the tools has a portion that is shaped similarly to the slot 24 to provide a very secure connection between the respective tool and the slot 24. The slot 24 also preferably extends approximately halfway between the longitudinal ends 30, 32 of the housing 28. This provides for a very secure connection between the secondary tool 26 and the housing 28 with very little slop, thus allowing for increased precision when using the secondary tool 26.

The multi-tool assembly 20 further includes at least one tool engaging element 44 for releasably securing the carpenter's pencil 26*a* or other secondary tool 26 within the slot 24. In the exemplary embodiment, the tool engaging element 44 is a set screw 44 which extends through one of the sides of the housing 28. Threading the set screw 44 in one direction tightens the engagement with the secondary tool 26 by pressing the set screw 44 against the secondary tool 26, and threading the set screw 44 in the opposite direction releases the engagement with the secondary tool 26 to allow for replacement of the secondary tool 26. FIG. 3 shows the set screw 44 threaded into an engaged position in contact with a contractor's pencil 26*a*. In the exemplary embodiment, the set screw 44 has an oversized head to allow a user to manually thread the set screw 44 by hand and without any special tools. For use with a carpenter's pencil 26*a*, this is particularly advantageous because it allows the position of the carpenter's pencil 26*a* within the slot 24 to be quickly adjusted in response to wearing of the carpenter's pencil 26*a*.

Figure 6:
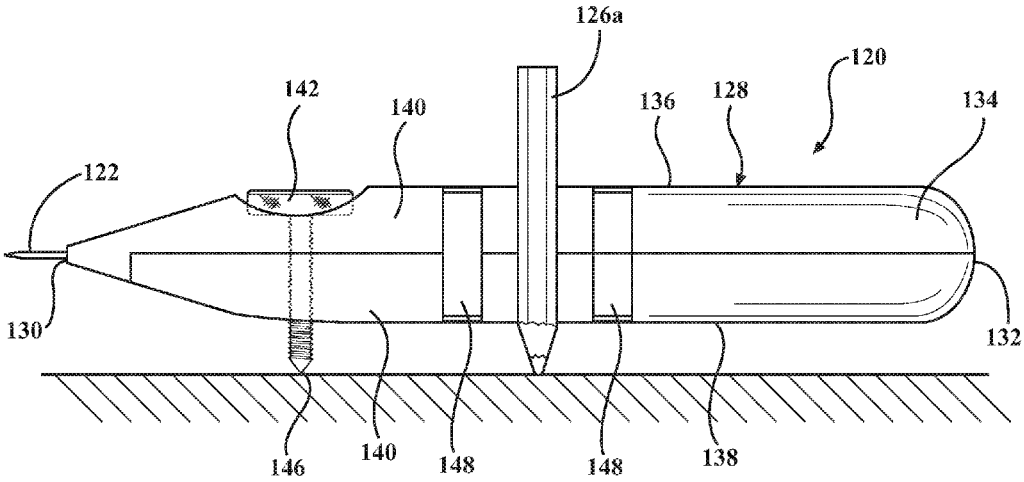
FIG. 6 is a side elevation view of the second exemplary embodiment of the multi-tool assembly in use drawing a circle.

Referring now to FIGS. 5 and 6, a second exemplary embodiment of the multi-tool assembly 120 is generally shown with like numerals, separated by a factor of, indicating corresponding parts with the first exemplary embodiment described above. The second exemplary embodiment is similar to the first exemplary embodiment described above, but is further configured to hold a pencil in a different way (other than with the above-discussed slot 24) for drawing circles. Specifically, the screw 142 which joins the two cover pieces 140 of the housing 128 together extends through the housing 128 and presents a point 146 for placing on a surface and rotating the housing 128 thereabout, and the housing 128 further includes a plurality of recesses 148 for releasably holding the pencil. The recesses 148 are formed into one of the sides of the housing 128 and are spaced longitudinally from one another and from the screw 142 by predetermined distances, such as one half of an inch (½") between adjacent recesses 148. Each of the recesses 148 is sized for frictionally holding a carpenter's pencil 126*a* in a direction parallel to the screw 142 and perpendicularly to the front 136 and back 138 of the housing 128. For example, FIG. 5 shows the carpenter's pencil 126*a* being held in one of the recesses 148 and showing the point 146 of the screw 142 engaging a surface for rotating the housing 128 about the point 146 to draw the circle with the carpenter's pencil 126*a*. This feature is particularly advantageous because a worker may very quickly draw a circle with a predetermined diameter (determined by which slot 124 the carpenter's pencil 126*a* is inserted) and then use the blade 122 in the utility knife assembly to cut along that pattern. Cutting circular patterns are particularly common in the drywall industry, and thus, this exemplary embodiment is particularly suited for drywall workers.

Figure 7:
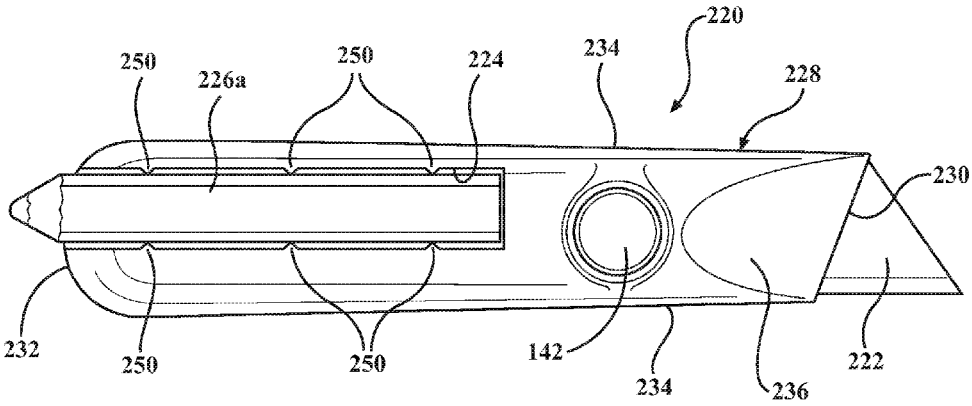
FIG. 7 is a front elevation view of a third exemplary embodiment of the multi-tool assembly and with a carpenter's pencil received therein.

Referring now to FIG. 7, a third exemplary embodiment of the multi-tool assembly 220 is generally shown with like numerals, separated by a factor of, indicating corresponding parts with the first and second exemplary embodiments described above. This embodiment is distinguished from the first exemplary embodiment described above by the slot 224 for receiving the secondary tool 226 being a longitudinally extending groove formed into the front 236 of the housing 228 and extending to the second longitudinal end 232 and by the tool engaging element 244 being a plurality of generally triangular teeth 244 for biting into a carpenter's pencil 226*a* and releasably securing the carpenter's pencil 226*a* with the housing 228. In this embodiment, the carpenter's pencil 226*a* may be pressed into the groove from the front 236 of the housing 228 so that the teeth 244 engage into the sides of the pencil. The positioning of the carpenter's pencil 226*a* may also be adjusted by removing it and repositioning it within the slot 224.

Referring back to FIGS. 5 and 6, another aspect of the present invention provides for a method of making a circular pattern on a surface. The method includes the step of providing a multi-tool assembly 120 which includes a housing 128 which extends between opposite first and second longitudinal ends 130, 132 and includes a blade 122 which projects out of the first longitudinal end 130 and a screw 142 which extends through the housing 128 and projects outwardly therefrom at a point 146 and wherein the housing 128 has at least one recess 148 formed in a side thereof which is spaced longitudinally from the screw 142. The method continues with the step of positioning a writing utensil, such as a carpenter's pencil 126*a*, having a tip within the recess 148 of the housing 128. The method proceeds with the step of placing the point 146 of the screw 142 and the tip of the writing utensil in contact with a surface. The method continues with the step of rotating the housing 128 of the multi-tool assembly 120 about the point 146 of the screw 142 to rotating the housing 128 of the multi-tool assembly

120 about the point 146 of the screw 142 to draw a circular pattern on the surface with the writing utensil.

Obviously, many modifications and variations of the present invention are possible in light of the above teachings and may be practiced otherwise than as specifically described while within the scope of the appended claims.

What is claimed is:

1. A multi-tool assembly, comprising:

a housing which extends between opposing first and second longitudinal ends;

a blade that is partially disposed within said housing and which projects out of said first longitudinal end of said housing;

said housing having a slot which opens to said second longitudinal end of said housing;

at least one tool engaging element disposed at least partially within said slot for releasably securing a tool in said slot at said second longitudinal end of said housing such that the tool projects out of said second longitudinal end;

said housing including a pair of cover elements that are joined with one another with a screw;

said screw extending through said housing and projecting therefrom with a point for rotating said housing about said point; and said housing further including a plurality of recesses that are spaced longitudinally from one another and from said screw for holding a writing utensil in a direction parallel to said screw for drawing circles around said screw.

2. The multi-tool assembly as set forth in claim 1 further including a pencil and wherein said at least one tool engaging element secures said pencil within said slot.

3. The multi-tool assembly as set forth in claim 1 wherein said tool engaging element is a set screw.

4. The multi-tool assembly as set forth in claim 3 wherein said set screw has an enlarged head for manual threading and unthreading by hand.

5. A multi-tool assembly, comprising:

a housing which extends between opposing first and second longitudinal ends, said housing having a pair of sides and a front and a back, said housing being made of two cover pieces which are fixed together, and said housing presenting an open interior between said cover pieces;

a blade that is partially disposed within said housing and which projects out of said first longitudinal end through an opening formed between said cover pieces;

at least one of said cover pieces of said housing presenting a slot which opens to said second longitudinal end of said housing;

a tool engaging element which extends through one of said sides of said housing and into said slot for releasably engaging a tool in said slot;

said housing including a screw joining said cover pieces of said housing together and extending past said housing to a point; and said housing presenting at least one recess which is spaced longitudinally from said screw by a predetermined distance, said recesses being shaped to receive a writing utensil and hold the writing utensil in a direction that is generally parallel to said screw for drawing circular shapes by spinning said housing around said point of said screw.

6. The multi-tool assembly as set forth in claim 5 and wherein said at least one recess in said housing is further defined as a plurality of recess which are spaced longitudinally from one another by predetermined distances.

7. The multi-tool assembly as set forth in claim 5 wherein said tool engaging element is a set screw.

8. The multi-tool assembly as set forth in claim 5 wherein said at least one recess is shaped to receive a carpenter's pencil.

* * * * *